United States Patent [19]

Stangl

[11] 4,317,156

[45] Feb. 23, 1982

[54] LOCKING DEVICE

[75] Inventor: Rupert Stangl, Oberwerrn, Fed. Rep. of Germany

[73] Assignee: Sachs-Systemtechnik GmbH, Schweinfurt, Fed. Rep. of Germany

[21] Appl. No.: 43,681

[22] Filed: May 30, 1979

[30] Foreign Application Priority Data

Jun. 6, 1978 [DE] Fed. Rep. of Germany ..... 2824684

[51] Int. Cl.[3] ..... E05B 27/00

[52] U.S. Cl. ..... 361/171; 70/413

[58] Field of Search ..... 361/171, 172; 70/413

[56] References Cited

U.S. PATENT DOCUMENTS

| | | | |
|---|---|---|---|
| 2,882,455 | 4/1959 | Ferguson, Jr. | 361/171 |
| 3,111,834 | 11/1963 | Felson | 70/413 |
| 3,416,336 | 12/1968 | Felson | 70/413 |
| 3,421,348 | 1/1969 | Hallman | 70/413 |
| 3,584,484 | 6/1971 | Hallmann | 70/413 |
| 4,232,353 | 11/1980 | Mosciatti et al. | 361/172 |

FOREIGN PATENT DOCUMENTS

| | | | |
|---|---|---|---|
| 2539757 | 10/1977 | Fed. Rep. of Germany | 70/413 |
| 1553000 | 1/1969 | France | 70/413 |

OTHER PUBLICATIONS

PCT WO79/00639, Herriot, et al., 9/1979.

*Primary Examiner*—A. D. Pellinen
*Assistant Examiner*—L. C. Schroeder
*Attorney, Agent, or Firm*—Toren, McGeady and Stanger

[57] ABSTRACT

A locking device includes a key having a locking code and a device for reading the locking code on the key and comparing it with a predetermined locking code. The key has a grip portion and an elongated information carrier extending outwardly from the grip portion. The key is insertable into an opening in the reading device. Magnetic information elements are provided along the information carrier and reading elements in the reading device read the information elements when the key is inserted. A projection extends outwardly from the information carrier transversely of its elongated direction. An information element is located on the projection and a corresponding reading element is provided within the reading device. The dimension of the projection outwardly from the information carrier is such that only the information element located on the projection can excite its corresponding reading element.

7 Claims, 1 Drawing Figure

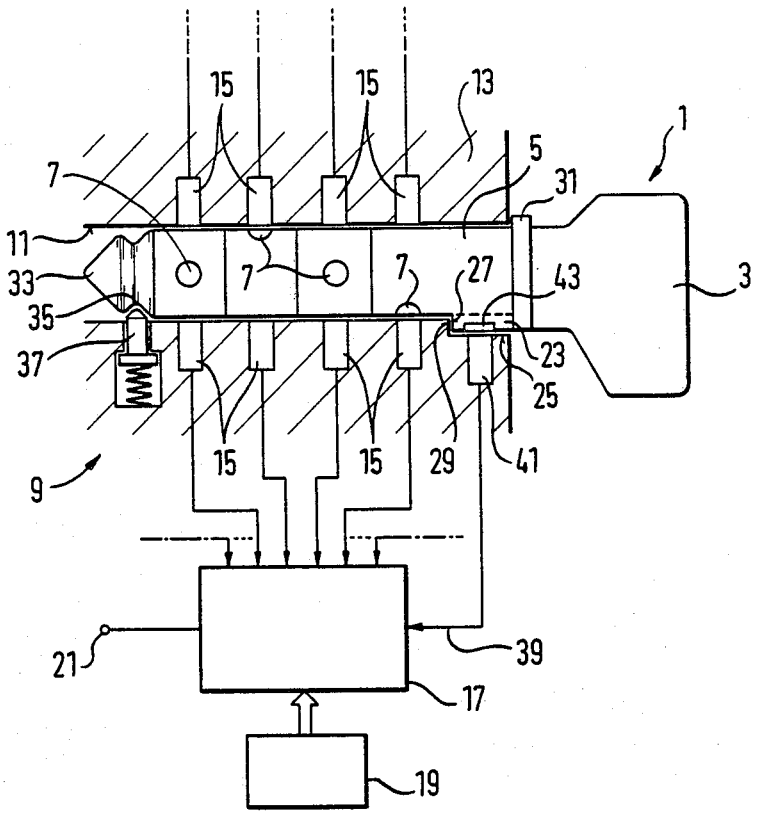
15
15
13
1
5
31
7
11
33
7
7
27
43
3
35
37
23
25
15
15
29
41
9
21
39
17
19

LOCKING DEVICE

SUMMARY OF THE INVENTION

The present invention is directed to a locking device including a key and a reading device. The key has a grip portion, and an information carrier extending from the grip portion on which information elements are arranged in a pattern establishing the locking code of the key. The reading device contains reading elements which read the locking code on the key and compare the locking code as read to a predetermined locking code.

A locking device of this general type is disclosed in German Pat. No. 21 38 991. This device is a mechanical lock having tumblers which can be placed in the unlocked position by switching magnets in the lock housing when a magnetic field of predetermined direction is located in the region of the switching magnets by means of the key. The key has two magnets arranged next to one another in a plane. The magnets are supported on locking discs which can be displaced about axes extending perpendicularly relative to the direction of magnetic polarization. By turning the locking discs, the angular position of the directions of polarization relative to one another can be changed so that the key is coded. This known locking device has the disadvantage that the size of the key increases disproportionately when a large number of coding variations is required.

Further, in German Utility Model No. 75 33 052 a flat key is disclosed for a cylinder lock. The key contains an insert of magnetizable material. The insert is magnetized in certain regions in different polarization directions and is read by the reading device of the lock cylinder when the flat key is inserted. The number of coding variations possible with this particular arrangement is relatively small. In addition, it is difficult to recognize when all the information elements have been read so that a proper comparison of the locking code as read with the predetermined locking code can be performed.

It is the primary object of the present invention to provide a predetermined position of the key relative to the reading device so that the position can be detected without error.

In accordance with the present invention, the information carrier portion of the key has an elongated shape and carries the magnetic information elements which determine the locking code along its peripheral surface. The information carrier portion of the key is inserted into an opening in the reading device. In addition to the information elements along its peripheral surface, an additional magnetic information element is provided on the carrier portion so that it can be read by a separate reading element in the reading device which has a susceptibility to a magnetic field. This additional information element is located on a projection which extends radially outwardly from the peripheral surface of the information carrier portion, that is, it extends transversely outwardly from the information carrier portion relative to its elongated direction. The radial distance outwardly from the elongated axis of the information carrier portion is made greater for the information element on the projection than for the remaining information elements on the carrier portion so that the reading element corresponding to the information element on the projection is excited during the insertion of the carrier portion only by the information element on the projection. Accordingly, the reading element corresponding to the information element on the projection, determines whether the key has been completely inserted into the reading device, and, if necessary, releases the reading device for scanning the locking code or for comparing it with the predetermined locking code.

Preferably, the projection is located at the end of the information carrier adjacent to the grip portion. With the projection arranged in this manner, it guides the key into the opening in the reading device as the information element on the projection approaches the region of the corresponding reading element in the reading device.

In embodiments where the information carrier has the shape of a circular cylinder, preferably the projection is inserted into a corresponding groove in the reading device. In such an arrangement, the projection prevents rotation of the key within the opening in the reading device and, in combination with the groove, aligns the information carrier relative to the reading device.

The additional information element located on the projection is advantageously located so that it is on the surface of the information carrier most remote from its axis. The entire projection can be formed of a permanently magnetic material which is magnetized in certain regions on the surface of the projection which is directed outwardly away from the axis of the information carrier. Alternatively, a separate permanent magnet could be positioned on the projection.

Another advantageous feature involves the provision of a stop surface on the end of the projection more remote from the grip portion and a complementary stop surface is provided in the reading device. The insertion of the key in the axial direction into the reading device can be regulated by means of this stop surface on the projection. In place of or in addition to the stop surface on the projection, the key can be provided with an outwardly projecting shoulder at the intersection of the grip portion and the carrier portion. The shoulder is located between the projection and the grip portion and abuts against an oppositely directed stop surface on the reading device. The shoulder can be formed by an increased diameter portion of the grip portion or by a flange projecting outwardly from the end of the information carrier adjacent to the grip portion.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiment of the invention.

BRIEF DESCRIPTION OF THE DRAWING

In the drawing a schematic side view, partly in section, is provided of a locking device embodying the present invention and consisting of a magnetic key and a reading device.

DETAIL DESCRIPTION OF THE INVENTION

In the drawing a key 1 is illustrated having a grip portion 3 for use in handling the key and a circular cylindrical information carrier 5 extending axially outwardly from the grip portion. Information carrier 5 includes a plurality of magnetic information elements 7 distributed in a pattern along the cylindrical axis of the information carrier and also in an angular pattern around the outer circumferential peripheral surface of the information carrier. The distribution of the magnetic information elements in the pattern establishes a binary locking code for the key in which the pattern of the information elements 7 correspond to a bit "1" and the vacant spaces in the pattern, that is, the spaces without an information element, represent a bit "0".

the locking code on the key can be read by a reading device 9. The information carrier 5 of the key 1 is inserted into a cylindrical opening 11 in the housing 13 of the reading device with the opening shaped to receive the information carrier 5. The reading device has a plurality of reading elements 15 susceptible to a magnetic field and arranged axially along as well as around the circumferential surface of the opening 11 in the pattern of the information elements 7. The reading elements respond either to the presence or absence of the information elements 7 in the pattern. The reading elements are connected to a comparator 17 which compares the locking code as read from the key to a locking code supplied from a code generator 19. When the predetermined locking code coincides with the locking code read from the key 1, the comparator 17 emits a signal at its output 21 which can be utilized for operating the lock, not shown.

The lock may be a central locking system or a theft protection system for a motor vehicle. The magnetic information elements 7 can be separate permanent magnets inserted into a non-magnetic body on the key. However, the key may be formed of a magnetic material which is magnetized in the zones in which the information elements are located. The reading elements may be Hall probes or reed switches.

At the end of the information carrier 5 adjacent the grip portion 3, an axially extending projection 23 extends radially outwardly from the cylindrical periphery of the information carrier 5. The projection 23 engages, in a form locking manner, in a groove 25 formed in the surface of the opening 11 within the housing 13 of the reading device 9. The groove 25 is adapted to receive the projection 23. The combination of the projection 23 and the groove 25 align the information carrier 5 in the circumferential direction relative to the reading elements 15 in the reading device 9. A shoulder 27 located at the end of the projection 23 more remote from the grip portion 3, determines the depth of insertion of the information carrier into the housing 13. In the fully inserted position of the key, the shoulder contacts a countershoulder 29 at the inner end of the groove 25. At the end of the information carrier 5, located just outside the housing when the key is fully inserted, an annular shaped shoulder 31 extends radially outwardly from the cylindrical periphery of the information carrier and the shoulder rests against the surface of the housing in the inserted position. The shoulder 27 and the annular shaped shoulder 31 can be dimensioned so that, in the inserted position of the key, they determine either jointly or individually the axially position of the key relative to the reading device. At the free end of the carrier 5, that is the end opposite the grip portion 3, a conically shaped stop head 3 is provided and a groove extends around the circumference of the stop head. In the inserted position of the key 1, a spring-loaded snap-in member 37, located at the inner end of the opening 11, engages within the groove 35. The snap-in member 37 can be displaced radially relative to the opening 11 permitting the insertion of the head. The conical surface of the stop head 33 forms an obliquely extending guide surface which deflects the snap-in member 37 out of its path as the key is inserted.

To prevent the comparator 17 from reading and comparing the code on the key before the key is fully inserted, the comparator 17 has a release input 39 connected to an additional reading element 41 which is susceptible to a magnetic field. The reading element 41 responds to an additional magnetic information element 43 positioned in the projection 23 on the information carrier 5. The information element 43 is spaced radially from the axis of the information carrier 5 by a greater amount than the remaining information elements 7 located along the circumferential periphery of the carrier. The radial distance of the information element 43 from the axis is selected so that the reading element is actuated only by the information element 43 and not by the information elements 7 which precede it as the key is inserted into the opening 11. The comparator is released only when the key is completely inserted into the housing. If necessary, a time delay can be incorporated into the release of the comparator to prevent the comparator from being released while the key is still in motion.

While specific embodiments of the invention have been shown and described in detail to illustrate the application of the inventive principles, it will be understood that the invention may be embodied otherwise without departing from such principles.

What is claimed is:

1. Locking device comprising a key having a locking code thereof and a reading device for reading the locking code, said key comprising a grip portion, an information carrier attached to said grip portion, and magnetic information elements located on said information carrier and arranged in a selected pattern for forming the locking code on the key, said reading device including reading elements susceptible to a magnetic field and arranged to read the locking code on said key and to compare the locking code as read to a predetermined locking code, wherein the improvement comprises that said information carrier is elongated and projects outwardly from said grip portion, said information carrier having an axis extending in the elongated direction thereof and an outer peripheral surface extending in the direction of and laterally surrounding said axis, said magnetic information elements comprise a plurality of first information elements located on, along and around the outer peripheral surface of said information carrier in the direction of the axis thereof and a second information element spaced in the axial direction of said information carrier from said first information elements, a projection on said information carrier extending outwardly from said outer peripheral surface transversely of said axis of said information carrier, said second information element located on said projection, said reading device comprising a housing having an elongated opening extending therein arranged to receive said information carrier, said projection arranged to interengage the opening in said housing so that said information carrier can be inserted in only one position relative to said reading elements in said opening, said reading elements comprising first reading elements and a second reading element located within said housing along the opening therein, said first reading element arranged to read said first information elements and said second reading element arranged to read said second information element, and the dimension extending transversely from the axis of said information carrier outwardly to said second information element on said projection is greater than the dimension extending transversely from the axis of said information carrier to said first information elements on the outer peripheral surface of said information carrier so that said second reading element is excited during the insertion of said key into the opening in said housing of said reading device only by said second information element.

2. Locking device, as set forth in claim 1, wherein said projection is located on the end of said information carrier adjacent to said grip portion.

3. Locking device, as set forth in claim 1, wherein said information carrier has the shape of an elongated circular cylinder, said first information elements and said first reading elements arranged to be spaced angularly apart around the axis of said information carrier and the opening in said housing of said reading device having a shape complementary to the cylindrical shape of said information carrier and having a groove formed therein complementary to and arranged to receive said projection on said information carrier.

4. Locking device, as set forth in claim 3, wherein said second information element comprises a separate permanent magnet located on said projection.

5. Locking device, as set forth in claim 3, wherein said projection is formed of a permanently magnetic material and said magnetic material is magnetized on the axially extending surface thereof facing outwardly from the axis of said information carrier for forming said second information element.

6. Locking device, as set forth in claim 1, wherein said projection has a stop surface thereon spaced from said grip portion and extending transversely of the axis of said information carrier and said surface forming a stop, and said housing of said reading device forming a corresponding stop surface arranged to be contacted by said stop surface on said projection when said key is inserted into the opening in said housing of said reading device.

7. Locking device, as set forth in claim 1, wherein said key includes an outwardly projecting shoulder extending outwardly transversely of the axial direction of said information carrier and located between said grip portion and the adjacent end of said information carrier, said housing having a stop surface arranged to be contacted by said shoulder when said key is inserted into the opening in said housing of said reading device, and the surface of said shoulder arranged to contact said stop surface on said housing faces away from said grip portion.

* * * * *